US011427233B2

(12) United States Patent
Heinrich et al.

(10) Patent No.: US 11,427,233 B2
(45) Date of Patent: Aug. 30, 2022

(54) METHOD FOR CALIBRATING A WHEEL SENSOR, CORRESPONDING WHEEL SENSOR, AND RAILWAY INSTALLATION WITH A WHEEL SENSOR OF THIS KIND

(71) Applicant: SIEMENS MOBILITY GMBH, Munich (DE)

(72) Inventors: Klaus Heinrich, Burgdorf/Berel (DE); Carsten Heise, Cremlingen (DE); Lutz-Helge Radwan, Gifhorn (DE); Eric Nannen, Meine (DE)

(73) Assignee: Siemens Mobility GmbH, Muencher (DE)

( * ) Notice: Subject to any disclaimer, the term of this patent is extended or adjusted under 35 U.S.C. 154(b) by 481 days.

(21) Appl. No.: 16/470,326

(22) PCT Filed: Nov. 16, 2017

(86) PCT No.: PCT/EP2017/079387
§ 371 (c)(1),
(2) Date: Jun. 17, 2019

(87) PCT Pub. No.: WO2018/108428
PCT Pub. Date: Jun. 21, 2018

(65) Prior Publication Data

US 2019/0329801 A1 Oct. 31, 2019

(30) Foreign Application Priority Data

Dec. 16, 2016 (DE) ..... 102016225276.3

(51) Int. Cl.
*B61L 1/02* (2006.01)
*B61L 1/16* (2006.01)

(52) U.S. Cl.
CPC ..... *B61L 1/167* (2013.01); *B61L 1/02* (2013.01); *B61L 1/162* (2013.01); *B61L 1/169* (2013.01)

(58) Field of Classification Search
CPC .. B61L 1/02; B61L 1/162; B61L 1/167; B61L 1/169
See application file for complete search history.

(56) References Cited

U.S. PATENT DOCUMENTS 5,395,078 A 3/1995 Gellender

FOREIGN PATENT DOCUMENTS

| | | | | |
|---|---|---|---|---|
| CA | 2685575 A1 * | 6/2011 | ..... | B61L 1/161 |
| CA | 2685575 A1 | 6/2011 | | |
| EP | 2289757 A2 | 3/2011 | | |
| WO | WO 9911497 A1 | 3/1999 | | |

* cited by examiner

*Primary Examiner* — Robert J McGarry, Jr.
(74) *Attorney, Agent, or Firm* — Laurence A. Greenberg; Werner H. Stemer; Ralph E. Locher

(57) ABSTRACT

A particularly flexible method for automatically calibrating a wheel sensor includes using the wheel sensor to determine that a calibration must be carried out. The wheel sensor determines a point in time suitable for carrying out the calibration and the calibration itself is carried out by the wheel sensor at the determined point in time. A wheel sensor for carrying out the method is also provided.

13 Claims, 2 Drawing Sheets

METHOD FOR CALIBRATING A WHEEL SENSOR, CORRESPONDING WHEEL SENSOR, AND RAILWAY INSTALLATION WITH A WHEEL SENSOR OF THIS KIND

BACKGROUND OF THE INVENTION

Field of the Invention

In the field of railway automation, wheel sensors are used by way of example for detecting wheels and counting axles in clear track signaling installations. Furthermore, wheel sensors are also used for other switching and signaling tasks such as by way of example a procedure that is triggered by the train for switching level crossing safety installations on or off or a train announcement. Appropriate wheel sensors that may use different operating principles usually detect wheels of rail-borne vehicles on the basis of their iron mass. In dependence upon the respective sensor type, it is necessary in this case by virtue of calibrating the wheel sensor to establish as a basic state the extent to which the wheel sensor is influenced by the rail alone in the absence of a wheel that is to be detected. In practice, this procedure must be repeated at regular temporal intervals in order by way of example to compensate for the wear that is experienced by the rail and accordingly to take this into consideration by virtue of calibrating the wheel sensor. Furthermore, it is possible for other changes and influencing variables to result in it being necessary to repeat the calibration of a wheel sensor.

In order to calibrate wheel sensors, work in the track area is usually necessary. In this case, the maintenance personal make sure that the wheel sensor that is to be calibrated is in an uninfluenced state and perform the calibration or measurement activity that is prescribed for the respective sensor type. This does not represent any large outlay when the wheel sensor is first being mounted because in this case the personal are already on site. However, this is not the case in the event of a regular or rather cyclical necessary re-calibration, since in this case it is necessary that the maintenance personal are present exclusively for the calibration of the wheel sensor.

A method for calibrating a wheel sensor of a track clear signaling installation is known from the European patent EP 2 289 757 B1, in which with regard to a track clear signaling section that is monitored by the wheel sensor becoming clear, a control computer of the track clear signaling installation transmits to the wheel sensor a clear-for-calibration signal that indicates permission for a calibration of the wheel sensor. Upon receiving the clear-for-calibration signal, the wheel sensor determines whether a calibration procedure is to be performed and, insofar as this is the case, said wheel sensor performs the calibration procedure. By virtue of this known method an automated calibration of wheel sensors is possible even without the presence of maintenance personal in the track region. The clear-for-calibration signal is used in this case to ensure that a calibration of the respective wheel sensor is only performed if a sufficiently long time frame is available in which the calibration may be performed without posing a danger to the regular train operation.

SUMMARY OF THE INVENTION

The object of the present invention is to specify a method which may be used in a particularly flexible manner for the automated calibration or measurement of a wheel sensor.

This object is achieved in accordance with the invention by virtue of a method for calibrating a wheel sensor, wherein the wheel sensor establishes that a calibration procedure is to be performed, the wheel sensor determines a point in time that is suitable for the calibration procedure to be performed and the wheel sensor performs the self-calibration procedure at the determined point in time.

In accordance with the first step of the method in accordance with the invention for calibrating a wheel sensor, the wheel sensor establishes that a calibration procedure is to be performed. This means that the wheel sensor itself performs a check using criteria known to said wheel sensor as to whether a calibration procedure is necessary at the respective point in time or not. The decision regarding this is thus made locally by means of the respective wheel sensor itself.

In accordance with the second step of the method in accordance with the invention, the wheel sensor determines a point in time that is suitable for the calibration procedure to be performed. This means that the wheel sensor not only independently decides whether a calibration procedure is to be performed but rather in addition said wheel sensor automatically also determines the point in time that is suitable for the calibration procedure to be performed. In this case, the point in time that is suitable for the calibration procedure is determined by the wheel sensor without the participation of other components. This means in particular that in this connection the wheel sensor does not receive any messages or signals from other components, possibly in the form of a higher-ranking control computer.

In accordance with the third step of the method in accordance with the invention, the wheel sensor performs a self-calibration procedure at the determined point in time. The actual calibration procedure is automatically performed in this case in a similar manner to the preceding method steps, in other words without it being necessary for maintenance personal to be involved.

The method in accordance with the invention therefore renders it possible for the wheel sensor to be automatically calibrated, wherein all the method steps are performed by the wheel sensor itself with the result that said wheel sensor is calibrated completely automatically. This offers in particular the advantage that further, higher-ranking components or rather communication with such components is not necessary for the calibration procedure of the wheel sensor to be performed. Consequently, the method in accordance with the invention may be used in a flexible manner regardless of the respective function and integration of the respective wheel sensor in the respective railway installation. Thus, it is particularly not necessary in the case of the method in accordance with the invention for the wheel sensor to receive data, messages or signals from another component. Consequently, the method in accordance with the invention is in particular also suitable for the calibration of such wheel sensors that only comprise one unidirectional interface for transmitting counting pulses or wheel passage signals, by way of example on one axle counting computer, but they are unable to receive signals.

Reference is made to the fact that within the scope of the present invention, the terms "calibrate" and "calibration" describe any actions and procedures in which the wheel sensor is calibrated or rather adjusted with respect to an uninfluenced state. In this case, the wheel sensor receives a new basic setting that goes beyond a simple drift tracking procedure. Thus, it is possible for the procedure of calibrating the wheel sensor to include by way of example an adjustment and accordingly a re-adjustment of switching thresholds or other operating parameters of the wheel sensor with regard to one or more measurement variable or measurement variables that are determined in the uninfluenced state of the wheel sensor.

Moreover, it is to be noted that the times of the first and the second step of the method in accordance with the invention may be interchanged or said steps may run completely or partially in parallel with one another. This means that the wheel sensor may also initially determine a point in time that is suitable for the calibration procedure to be performed and only subsequently perform a check as to whether a calibration procedure is actually to be performed. Furthermore, the corresponding check may include by way of example also multiple part-steps, of which at least one may be performed prior to and at least one after determining the point in time that is suitable for the calibration procedure to be performed. Moreover, it is also possible that the procedure of determining the point in time that is suitable for the calibration procedure to be performed may include multiple part-steps, of which at least one is performed prior to and at least one after performing the check as to whether a calibration procedure is to be performed.

In order to avoid misunderstandings, it is moreover to be noted at this point that within the scope of the present invention any device for detecting wheels or axles of a rail-borne vehicle is described as a wheel sensor. This applies regardless of the respective operating principle and also independently therefrom whether the relevant device includes merely one component that is arranged on one side of a rail or multiple components that are arranged on one side or two sides of a rail. In the latter case, the wheel sensor may comprise by way of example at least one transmitting unit and at least one receiving unit. In dependence upon the respective embodiment and application, wheel sensors are known within the meaning of the present invention also under the terms "counting point", "axle counting point" or "rail contact".

In dependence upon the functioning mode and configuration of the respective wheel sensor, it is fundamentally possible that different points in time may be suitable for the calibration procedure to be performed.

It is preferred that the method in accordance with the invention is further developed in such a manner that the point in time that is suitable for the calibration procedure to be performed is determined by the wheel sensor with reference to the fact that it has been detected that a rail-borne vehicle has completely driven past the wheel sensor. This is advantageous since once the wheel sensor has been driven past, in other words by way of example after a train has completely driven past said wheel sensor, generally a time frame that is sufficiently long for the calibration procedure is available in which by taking into consideration the minimal succession of trains, it is not expected that any further trains will drive pass said sensor.

As an alternative to the previously described embodiment, it is by way of example also conceivable that the calibration procedure is performed between the detection of sequential wheels. This requires that the calibration procedure takes only a very short time, approximately in the micro-second range. In this case, the point in time that is suitable for the calibration procedure to be performed is consequently determined with reference to the fact that it has been detected that a wheel of the rail-borne vehicle has completely driven past the wheel sensor.

In accordance with a further particularly preferred embodiment of the method in accordance with the invention, by taking into consideration a time sequence in which the wheels of the rail-borne vehicle are detected, the wheel sensor detects that the rail-borne vehicle has completely driven past the wheel sensor. In the case of a rail-borne vehicle, possibly in the form of a train, driving past the wheel sensor, multiple wheels are detected by the respective wheel sensor within a determined period of time. By taking into consideration the time sequence in which the wheels of the rail-borne vehicle are detected, it is possible in this case for the wheel sensor to conclude that the rail-borne vehicle has now driven past and consequently to establish the presence of a point in time that is suitable for the calibration procedure to be performed.

In an advantageous manner, the method in accordance with the invention may accordingly be further developed in such a manner that the wheel sensor detects that the rail-borne vehicle has completely driven past the wheel sensor insofar as the wheel sensor does not detect a further wheel within a predetermined time period or within a time period that may be determined by the wheel sensor. In an advantageous manner, the predetermined time period or the time period that may be determined by the wheel sensor is selected in this case in such a manner that said time period is essentially longer than the pauses between the detection of individual wheels of the rail-borne vehicle with the result that it is possible with a high degree of reliability to conclude that the rail-borne vehicle has actually completely driven past the wheel sensor.

In accordance with a further particularly preferred embodiment of the method in accordance with the invention, the wheel sensor determines the velocity of the rail-borne vehicle and/or a change in the velocity of the rail-borne vehicle and takes this into consideration when detecting that the rail-borne vehicle has completely driven past the wheel. It is hereby intended in particular to avoid that as a result of the rail-borne vehicle being decelerated or coming to a standstill the wheel sensor erroneously assumes that the rail-borne vehicle has already completely driven past the wheel sensor. In this case, the velocity or the change in velocity of the rail-borne vehicle may be determined by the wheel sensor on the basis of the temporal interval between the detection of wheels of the rail-borne vehicle. Thus, longer temporal intervals are an indication that the rail-borne vehicle is decelerating, which in dependence upon the times between the detections of individual wheels may possibly be an indication that the rail-borne vehicle is coming to a standstill or has come to a standstill in the region of the wheel sensor. In dependence upon the type of the respective wheel sensor, it is also possible to conclude the velocity of the rail-bore vehicle from the length of the wheel pulses that are detected by the wheel sensor or also from the increase and/or drop in velocity of the flanks of the wheel pulses. In this case, it is to be noted that it is not necessary to determine the velocity precisely since only such situations are to be detected in which the rail-borne vehicle is driving very slowly or rather comes to a standstill in the region of the wheel sensor. In this case, after detecting the corresponding situation the wheel sensor may advantageously postpone a due calibration procedure to such an extent that the respective point in time is detected as being unsuitable for the calibration procedure to be performed. The same may also apply by way of example for the case that a no-traffic value that is detected by the wheel sensor is different prior to and after the vehicle drives past said wheel sensor, since this may be an indication that possibly one wheel of the rail-borne vehicle is on the wheel sensor or in the region of the wheel sensor.

The wheel sensor may establish in a different manner whether or rather that a calibration procedure is to be performed. Within the scope of the method in accordance with the invention, it is only of importance in this case that the wheel sensor establishes in a completely autonomous manner the corresponding requirement for a calibration procedure.

In an advantageous manner, the method in accordance with the invention may also be configured in such a manner that, by taking into consideration a comparison of at least one measured value with at least one desired value, the wheel sensor establishes that a calibration procedure is to be performed. This is advantageous since by virtue of such a comparison it is possible to ensure a calibration procedure is performed only when necessary. This means in particular that the wheel sensor is only calibrated if the calibration is actually necessary as a result of the deviation of the at least one measured value, said measured value preferably relating to the uninfluenced state of the wheel sensor.

In accordance with a further particularly preferred further development of the method in accordance with the invention, a temporal mean value of the at least one measured value is accordingly formed and the temporal mean value of the at least one measured value is compared with the at least one desired value. By virtue of using a temporal mean value of the at least one measured value, it is ensured that individual measured values that deviate from the desired value do not directly result in a calibration of the wheel sensor.

It is preferred that the temporal mean value of the at least one measured value is formed over a time period of one day or of multiple days. This is advantageous to the extent that in this case in particular also effects that are dependent upon the time of day, such as in the form of a dependency upon temperature, are averaged out and it is avoided that such effects trigger the calibration of the wheel sensor. When averaging the at least one measured value over one day, in other words over a time period of exactly or at least essentially 24 hours or multiple days, in other words essentially a multiple of 24 hours, such effects that are dependent upon the time of day are advantageously taken into consideration in a simple manner.

In accordance with a further particularly preferred embodiment of the method in accordance with the invention, the wheel sensor establishes that a calibration procedure is to be performed insofar as the comparison of the at least one measured value with the at least one desired value results in a deviation that lies in a predetermined value range. This means on the one hand that the deviation must exceed a specific minimum value in order to trigger a calibration of the wheel sensor. The reason for this is that the smallest deviations between the at least one measured value and the at least one desired value are not to lead to a calibration of the wheel sensor, said measured value being by way of example a measured value that is detected within the scope of a previous calibration procedure. Furthermore, it is also possible for a calibration procedure of the wheel sensor not to be performed in dependence upon the respective conditions if the value of the deviation between the at least one measured value and the at least one desired value is too great. In this case, the deviation consequently exceeds the "calibration range" with the result that it is not expedient to calibrate the wheel sensor. The reasons for this may be by way of example a malfunction of the wheel sensor, the wheel sensor being influenced by a wheel or by the wheel sensor falling off the rail.

As an alternative or in addition to the previously mentioned preferred further development of the method in accordance with the invention, this may be advantageously characterized in such a manner that the wheel sensor establishes that a calibration procedure is to be performed insofar as a predetermined time period has elapsed since the last calibration procedure. In this case, a corresponding temporal condition may be used alone or however linked with a comparison of at least one measured value with at least one desired value with the result that a calibration of the wheel sensor is only performed or rather necessary if since the last calibration procedure a predetermined time period is exceeded and simultaneously if it is established that the measured value of the wheel sensor deviates from the desired value.

The method in accordance with the invention may be used both for single channel and also for two channel wheel sensors. In this case, two channel wheel sensors that are also described as dual sensors are usually used for direction recognition of rail-borne vehicles.

In an advantageous manner, the method in accordance with the invention may be characterized in such a manner that in the case of a wheel sensor having two sensor channels the method is performed in each of the two sensor channels independently of one another. This offers the advantage that each of the two sensor channels may decide independently the need for and the point in time of their calibration. As a consequence, in particular dependencies between the sensor channels which could otherwise impair the safety of the wheel sensor are avoided.

As an alternative to the previously mentioned embodiment, the method in accordance with the invention may also be advantageously further developed in such a manner that in the case of a wheel sensor having two sensor channels the method is performed across both sensor channels. This offers the advantage that on the one hand it is possible to coordinate the two sensor channels so that they do not perform a calibration procedure simultaneously. This may be advantageous by way of example so that by means of the respective other sensor channel it is possible even during a calibration procedure to detect that a rail-bore vehicle is unexpectedly driving past, which may be advantageous with regard to the fail-safe operation of the wheel sensor. Furthermore, there is fundamentally the possibility that, within the scope of the calibration of the wheel sensor, information from the two sensor channels is combined in order to determine by way of example the velocity of a rail-bore vehicle that is driving past and to take this into consideration when deciding if a suitable point in time is available for a necessary calibration.

The invention relates furthermore to a wheel sensor, in particular for a track clear signaling installation.

With respect to the wheel sensor, the object of the present invention is to specify a wheel sensor that supports a method which may be used in a particularly flexible manner for the automated calibration of the wheel sensor.

This object is achieved in accordance with the invention by virtue of a wheel sensor, in particular for a track clear signaling installation, wherein the wheel sensor is configured in such a manner that said wheel sensor establishes that a calibration procedure is to be performed, said wheel sensor determines a point in time that is suitable for the calibration procedure to be performed and said wheel sensor performs a self-calibration procedure at the determined point in time.

The advantages of the wheel sensor in accordance with the invention correspond to those of the method in accordance with the invention with the result that in this respect reference is made to the corresponding above explanations.

In accordance with a particular preferred further development, the wheel sensor in accordance with the invention is configured so as to perform the method in accordance with one of the previously described preferred further developments of the method in accordance with the invention. In this case, the advantages of the respective further development of the wheel sensor in accordance with the invention correspond in turn to those of the corresponding preferred further development of the method in accordance with the invention, with the result that also in this respect reference is made to the corresponding above explanations.

The invention includes furthermore a railway installation, in particular a track clear signaling installation, having at least one wheel sensor in accordance with the invention or having at least one wheel sensor in accordance with the previously mentioned preferred further development of the wheel sensor in accordance with the invention.

BRIEF DESCRIPTION OF THE SEVERAL VIEWS OF THE DRAWING

The invention is explained in detail below with reference to exemplary embodiments. In the drawings.

DESCRIPTION OF THE INVENTION

Figure 1:
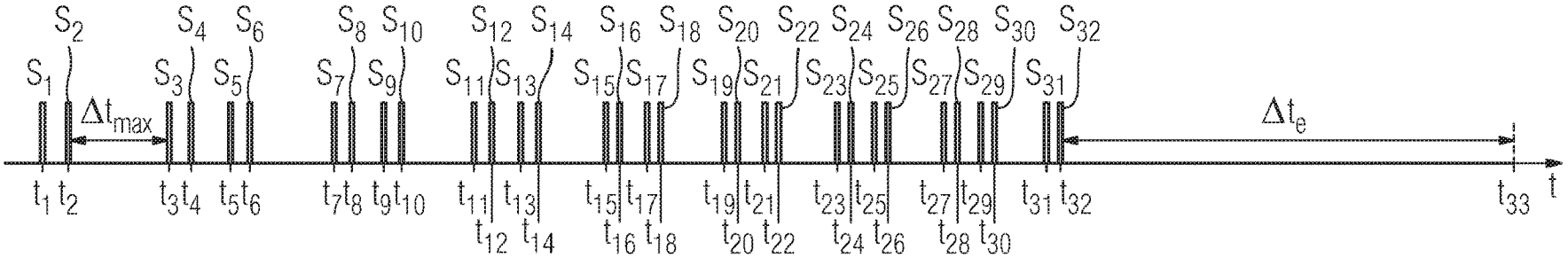
FIG. 1 for explaining an exemplary embodiment of the method in accordance with the invention illustrates in a schematic drawing signals detected by a wheel sensor as a rail-borne vehicle is driving past and FIG. 2 for further explaining the exemplary embodiment of the method in accordance with the invention illustrates a flow diagram.

FIG. 1 for explaining an exemplary embodiment of the method in accordance with the invention illustrates in a schematic drawing signals detected by a wheel sensor as a rail-borne vehicle is driving past. The figure illustrates signals $S_1$ to $S_{32}$ that are detected by a wheel sensor within the scope of a rail-borne vehicle driving past. In this case, the term "drive past" is to be understood such that the wheels of the rail-borne vehicle move through a detection region of the wheel sensor and are consequently detected by said wheel sensor. The corresponding wheel sensor may be used for different switching and controlling tasks within the scope of an automated railway operation and in particular may be a component of a track clear signaling installation. According to the illustration in FIG. 1, the signals $S_1$ to $S_{32}$ are detected by the wheel sensor at the points in time $t_1$ to $t_{32}$. Within the scope of the described exemplary embodiment, it is to be assumed by way of example that the rail-borne vehicle comprises eight vehicles each with four axles, wherein in each case two axles may be incorporated into one bogie. In this case, it is possible by way of example in each case for the signals $S_1$ to $S_4$, $S_5$ to $S_8$, $S_9$ to $S_{12}$, $S_{13}$ to $S_{16}$, $S_{17}$ to $S_{20}$, $S_{21}$ to $S_{24}$, $S_{25}$ to $S_{28}$ and $S_{29}$ to $S_{32}$ to relate to wheels of a corresponding vehicle or rather vehicle part, possibly in the form of a locomotive or a wagon of the rail-borne vehicle.

It is apparent in FIG. 1 that the maximum temporal interval between the sequential signals $S_1$ to $S_{32}$ that is identified by $\Delta t_{max}$ occurs between the detection of the second and third axle of the first vehicle. Usually the maximum axle spacing within a rail-borne vehicle is approximately 20 m, with the result that from the respective velocity of the rail-borne vehicle and accordingly from an anticipated velocity of said rail-borne vehicle, it is possible to determine the maximum interval $\Delta t_{max}$ between the sequential signals $S_1$ to $S_{32}$. It is to be noted that the maximum temporal interval $\Delta t_{max}$ could naturally also occur in one of the other vehicles of the rail-borne vehicle in dependence upon a possible change in velocity of the rail-borne vehicle and in dependence upon the respective vehicle types.

Insofar as the wheel sensor has now established that a self-calibration procedure is to be performed, said wheel sensor may determine a point in time that is suitable for the calibration procedure to be performed. In this case, the wheel sensor may derive the point in time at which a calibration procedure is to be triggered or rather the point in time at which to trigger a calibration procedure essentially from the sequence of states "not clear"/"clear" of one sensor system or in the case of a two channel dual sensor of both sensor systems. In the latter case, the decision regarding the point in time at which a calibration procedure is permissible and accordingly which point in time is suitable for a calibration procedure may be taken in each part-system or rather channel of the wheel sensor and accordingly of the axle counting point separately or from the result of both part-systems. It is essential in this case that further components, such as by way of example an axle counting computer in the internal system, are not involved in determining the point in time that is suitable for the calibration procedure to be performed. This is in particular advantageous in such cases in which as a consequence a change in the interface between the respective wheel sensor and the internal system is avoided.

In the exemplary embodiment illustrated in FIG. 1, after the last signal $S_{32}$ at the point in time $t_{32}$ until at a point in time $t_{33}$, the wheel sensor does not detect any further rail-borne vehicle driving past, in other words does not detect any further axle. Consequently, after the last axle of the rail-borne vehicle has been detected using the signal $S_{32}$, the interval $\Delta t_e$ is considerably greater than the maximum temporal interval $\Delta t_{max}$ between the sequential signals $S_1$ to $S_{32}$. This is used by the wheel sensor as a criterion for detecting that the relevant rail-borne vehicle has completely driven past the wheel sensor and consequently the point in time $t_{33}$ is determined as a point in time that is suitable for the calibration procedure to be performed. On account of the usual sequence of train intervals, it is hereby ensured that during the calibration procedure a rail-borne vehicle is not expected to drive past the wheel sensor and consequently the calibration procedure does not impair the detection or signaling of a subsequent rail-borne vehicle driving over said wheel sensor.

Irrespective of this, the wheel sensor is however advantageously configured in such a manner that even during the calibration procedure said wheel sensor may correctly signal that wheels are driving over it or however at least detect that wheels are driving over it and may distribute an error message. Different embodiments are possible in this case depending up the design of the respective wheel sensor. Thus, even the shortest time periods during which a wheel is driving past, in other words at the highest occurring velocity, typically amount to approx. 3 ms. Insofar as the wheel sensor performs self-calibration more quickly or said wheel sensor is not impaired by means of a calibration procedure with regard to its detection ability, the performance of the calibration procedure does not have any influence on the reliability of the wheel sensor. If the situation occurs that the wheel sensor on account of or rather during its calibration procedure does not perform an error-free counting procedure, then this does not lead to a safety-critical situation in the event of an individual error at least in the case of a wheel sensor of an axle counting device even for the case that contrary to expectation a rail-borne vehicle is driving over the wheel sensor during the calibration procedure. Although as a consequence an axle counting error could occur that possibly results in an interruption of the train operation; insofar as it is possible to reliably exclude that the wheel sensor is "blind" with regard to a rail-borne vehicle having completely driven past it, a corresponding axle counting error is however not critical as far as safety aspects are concerned.

According to the above explanations, with reference to the fact that it has been detected that a rail-borne vehicle has completely driven past the wheel sensor it is possible for the wheel sensor to determine the point in time that is suitable for the calibration procedure to be performed and subsequently for the wheel sensor to perform the self-calibration procedure at the determined point in time. As explained with reference to the illustration in FIG. 1, it is possible by taking into consideration a temporal sequence of detecting wheels of the rail-borne vehicle to detect that the rail-borne vehicle has completely driven past the wheel sensor. Specifically, it is possible for the wheel sensor to detect that the rail-borne vehicle has completely driven past the wheel sensor by way of example if the wheel sensor does not detect a further wheel within a predetermined time period or within a time period that may be determined by the wheel sensor $\Delta t_e$. In this case, the time period may be predetermined to the extent that it is set to a constant value of by way of example 45 s.

As an alternative thereto, the time period may also be determined by way of example by the wheel sensor itself. In this case, it is by way of example conceivable that the time period $\Delta t_e$ amounts to a multiple of the maximum interval $\Delta t_{max}$ detected by the wheel sensor between the sequential signals $S_1$ to $S_{32}$. The time period $\Delta t_e$ may thus be selected by way of example to be five times or ten times the maximum temporal interval $\Delta t_{max}$ or rather may be determined by the wheel sensor itself. Where appropriate, it is possible in this case by way of example to also take into consideration the braking capacity of the trains traveling on the respective stretch of rail, in order even in the case of the respective rail-borne vehicle braking in the region of the relevant wheel sensor to be able to reliably rule out that the rail-borne vehicle has braked heavily in the region of the wheel sensor and has possibly come to a standstill and consequently has not completely driven past the wheel sensor. Where appropriate, it is also possible in this case for the wheel sensor to determine the velocity of the rail-borne vehicle and/or a change in velocity of said rail-borne vehicle and for this to be taken into consideration when detecting that the rail-borne vehicle has completely driven past the wheel sensor.

After it has been explained in particular in connection with FIG. 1 how the wheel sensor may determine a point in time that is suitable for the calibration procedure to be performed, the exemplary embodiment of the method in accordance with the invention is to be further explained below with reference to FIG. 2.

Figure 2:
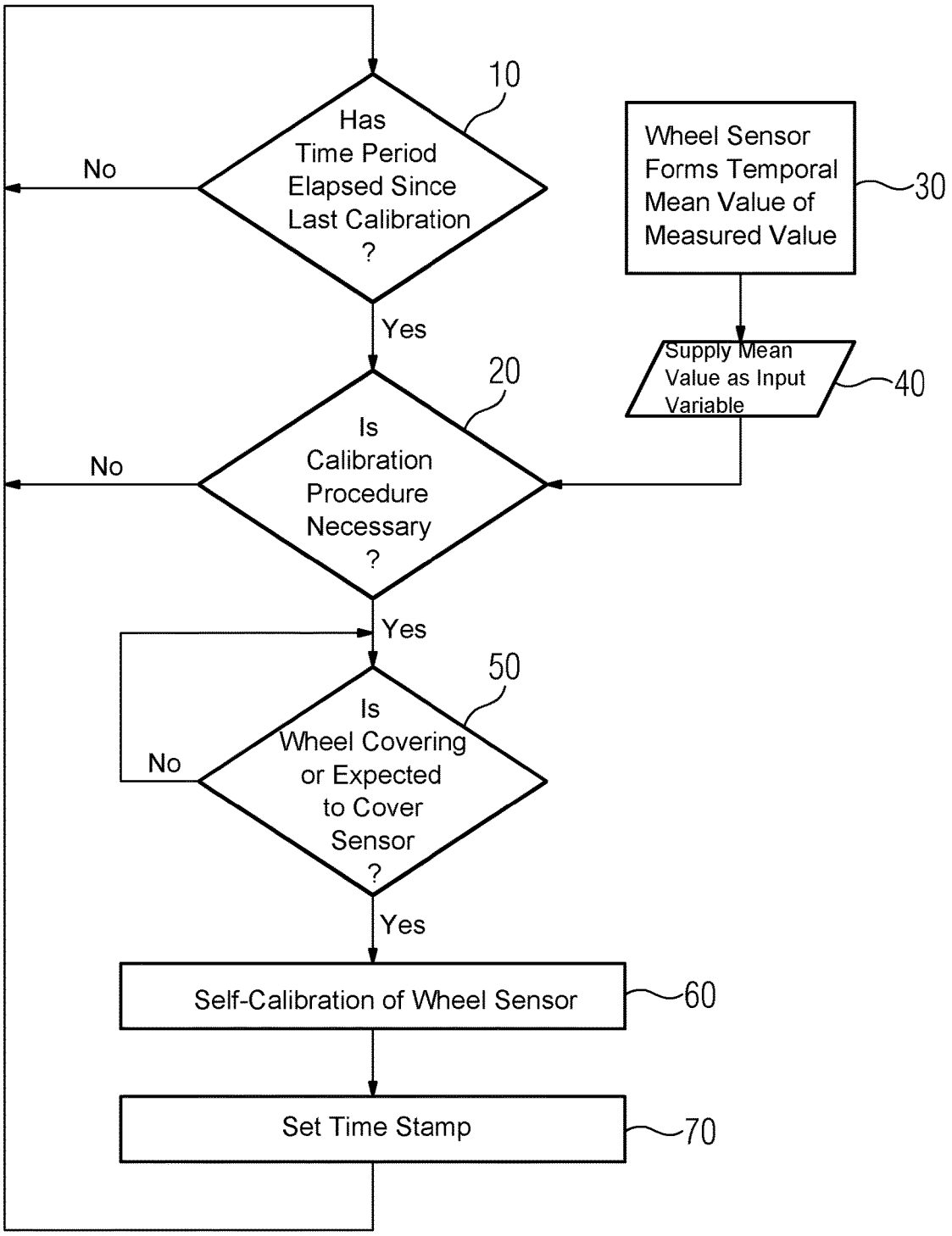

FIG. 2 illustrates a flow diagram for further explaining the exemplary embodiment of the method in accordance with the invention.

It is assumed within the scope of the algorithm described by way of example below, that a check is initially performed in a method step 10 as to whether a predetermined time period has elapsed since the last calibration procedure. In this case, the predetermined time period may be by way of example one month or also three months, in which case the wheel sensor would have been calibrated at a maximum monthly or rather at a maximum every three months. Insofar as the condition is fulfilled, in other words the predetermined time period has elapsed since the last calibration period the method moves on to step 20; failing this the method returns to the starting point so that by way of example a check is performed in turn at regular temporal intervals as to whether in the meantime the predetermined time period has elapsed since the last calibration procedure.

In the method step 20, the wheel sensor performs a check as to whether it is necessary to perform a calibration procedure by taking into consideration a comparison of at least one measured value with at least a desired value. In the described exemplary embodiment, it is assumed in this case that in a method step 30 the wheel sensor forms a temporal mean value of a measured value in the form of a rectified or rather open-circuit voltage of the wheel sensor and this mean value is supplied in a method step 40 as an input variable to the check step 20. In an advantageous manner, in this case a temporal mean value is formed over a time period of one day or of multiple days in order to determine therefrom in particular effects that are dependent upon the time of day, such as by way of example temperature effects.

The wheel sensor checks in method step 20 with reference to a comparison of the at least one measured value in the form of the mean value of the rectified voltage in the track-clear state with a desired value, possibly in the form of the value of the rectified voltage that is determined within the scope of the last calibration procedure, as to whether there is a deviation in a predetermined value range. In this case, a check is consequently performed to establish that the relevant deviation is not too large and not too small and the wheel sensor is consequently located in a "calibratable range". Insofar as this is the case, the method moves onto the method step 50. Failing this, the method returns to the starting point since it is not necessary or rather not expedient to calibrate the wheel sensor by taking into consideration the measured value.

After it has been established in the preceding steps that a calibration procedure is to be performed, the wheel sensor determines in the method step 50 a point in time that is suitable for the calibration procedure to be performed. This means that the wheel sensor checks whether a wheel of a rail-borne vehicle is covering said wheel sensor or whether it is to be expected that a wheel will accordingly cover said wheel sensor or rather drive over said wheel sensor. According to the explanations in connection with FIG. 1, this may occur by way of example by virtue of the fact that the wheel sensor detects that a rail-borne vehicle has completely driven past said wheel sensor and said wheel sensor determines the relevant point as a point in time that is suitable for the calibration procedure to be performed. Insofar as the wheel sensor has determined the respective point in time as being suitable for the self-calibration to be performed, the wheel sensor performs the self-calibration in the method step 60. Failing this, the wheel sensor repeats the check, in particular as the next rail-borne vehicle drives over said wheel sensor, as to whether or rather if a point in time that is suitable for the calibration procedure to be performed is present.

After the wheel sensor has been calibrated in the method step 60, a time counter is reset or rather a time stamp is set in the method step 70. This information may subsequently be used by the wheel sensor during the next performance of the method step 10 in order to decide whether from the time point of view it is necessary to perform a calibration procedure.

According to the above explanations in connection with the exemplary embodiment of the method in accordance with the invention, this method and also a wheel sensor that is configured so as to perform the method in particular comprise the advantage that the wheel sensor itself completely controls and performs the calibration procedure. This means in particular that the wheel sensor alone also determines a point in time that is suitable for the calibration procedure to be performed. By virtue of the corresponding automatic independent calibration of the wheel sensor, there is on the one hand the advantage that owing to the wheel sensor itself determining that a calibration procedure is necessary, predetermined fixed inspection periods are no longer required. Moreover, by virtue of the wheel sensor performing the calibration procedure independently, it is advantageously possible to also increase the availability of the wheel sensor and consequently to increase the availability of the railroad installation which said wheel sensor is part of. As a consequence of the fact that it is not necessary to transfer information from other components to the wheel sensor so as to perform the calibration procedure, the method may furthermore also be used advantageously for such situations or rather wheel sensors in which only a unidirectional interface is available between the wheel sensor and by way of example an axle counting computer, with the result that a corresponding transfer of information would not be possible or rather would make it necessary to change the interface by way of example to the internal system.

The invention claimed is:

1. A method for calibrating a wheel sensor, the method comprising the following steps:

using the wheel sensor to establish that a decentralized calibration procedure is to be performed;

using the wheel sensor to provide a self-acting determination of a point in time being suitable for the calibration procedure to be performed with reference to a detection that a rail-borne vehicle has completely driven past the wheel sensor by taking into consideration a temporal sequence of detecting wheels of the rail-borne vehicle; and using the wheel sensor to automatically perform a self-calibration at the determined point in time.

2. The method according to claim 1, which further comprises carrying out the step of using the wheel sensor to detect that a rail-borne vehicle has completely driven past the wheel sensor by determining that the wheel sensor does not detect a further wheel within a predetermined time period or within a time period that may be determined by the wheel sensor.

3. The method according to claim 1, which further comprises using the wheel sensor to determine at least one of a velocity of the rail-borne vehicle or a change in a velocity of the rail-borne vehicle and taking at least one of the velocity or the change in a velocity into consideration when detecting that the rail-borne vehicle has completely driven past the wheel sensor.

4. The method according to claim 1, which further comprises carrying out the step of using the wheel sensor to establish that the calibration procedure is to be performed by taking into consideration a comparison of at least one measured value with at least one desired value.

5. The method according to claim 4, which further comprises forming a temporal mean value of the at least one measured value and comparing the temporal mean value of the at least one measured value with the at least one desired value.

6. The method according to claim 5, which further comprises forming the temporal mean value of the at least one measured value over a time period of one day or multiple days.

7. The method according to claim 4, which further comprises carrying out the step of using the wheel sensor to establish that the calibration procedure is to be performed by determining if the comparison of the at least one measured value with the at least one desired value results in a deviation lying in a predetermined value range.

8. The method according to claim 1, which further comprises carrying out the step of using the wheel sensor to establish that the calibration procedure is to be performed if a predetermined time period has elapsed since a last calibration procedure.

9. The method according to claim 1, which further comprises providing a wheel sensor having two sensor channels and performing the method in each of the two sensor channels independently of one another.

10. The method according to claim 1, which further comprises providing a wheel sensor having two sensor channels and performing the method across the two sensor channels.

11. A vehicle, comprising:

a wheel sensor for establishing in a decentralized manner that a calibration procedure is to be performed;

said wheel sensor determining in a self-acting manner a point in time being suitable for the calibration procedure to be performed with reference to a detection that a rail-borne vehicle has completely driven past said wheel sensor by taking into consideration a temporal sequence of detecting wheels of the rail-borne vehicle; and said wheel sensor automatically performing a self-calibration procedure at the determined point in time.

12. The vehicle according to claim 11, wherein said wheel sensor is part of a track clear signaling installation.

13. A railway installation or track clear signaling installation, comprising a vehicle according to claim 11 having at least one said wheel sensor.

* * * * *